US006732804B2

(12) United States Patent
Hosie et al.

(10) Patent No.: US 6,732,804 B2
(45) Date of Patent: May 11, 2004

(54) DYNAMIC MUDCAP DRILLING AND WELL CONTROL SYSTEM

(75) Inventors: David Hosie, Sugar Land, TX (US); Ramkumar K Bansal, Houston, TX (US); Robert L. Cuthbertson, Columbus, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/154,437

(22) Filed: May 23, 2002

(65) Prior Publication Data

US 2003/0217849 A1 Nov. 27, 2003

(51) Int. Cl.[7] ..... E21B 43/12

(52) U.S. Cl. ..... 166/373; 166/321; 166/386; 175/318

(58) Field of Search ..... 175/318, 317, 175/57; 166/373, 374, 386, 319, 321, 334.4

(56) References Cited

U.S. PATENT DOCUMENTS

| | | | | |
|---|---|---|---|---|
| 5,040,606 A | * | 8/1991 | Hopper | 166/319 |
| 6,209,663 B1 | | 4/2001 | Hosie | 175/57 |
| 6,325,146 B1 | * | 12/2001 | Ringgenberg et al. | 166/250.17 |
| 6,367,566 B1 | * | 4/2002 | Hill | 175/57 |
| 2001/0023765 A1 | | 9/2001 | Patel | 166/375 |
| 2002/0007968 A1 | | 1/2002 | Gardes | 175/57 |

FOREIGN PATENT DOCUMENTS

| | | | |
|---|---|---|---|
| WO | WO 00/52299 | 9/2000 | E21B/21/00 |
| WO | WO 01/90528 | 11/2001 | E21B/7/06 |
| WO | WO 02/10549 | 2/2002 | E21B/19/22 |
| WO | WO 02/084067 | 10/2002 | E21B/21/08 |

OTHER PUBLICATIONS

PCT International Search Report, International Application No. PCT/US 03/15366, dated Oct. 23, 2003.

* cited by examiner

*Primary Examiner*—Zakiya Walker
(74) *Attorney, Agent, or Firm*—Moser, Patterson & Sheridan, L.L.P.

(57) ABSTRACT

A method and an apparatus for a dynamic mudcap drilling and well control assembly is provided. In one embodiment, the apparatus comprises of a tubular body disposable in a well casing forming an outer annulus there between and an inner annulus formable between the body and a drill string disposed therein. The apparatus further includes a sealing member to seal the inner annulus at a location above a lower end of the tubular body and a pressure control member disposable in the inner annulus at a location above the lower end of the tubular body. In another embodiment, the assembly uses two rotating control heads, one at the top of the wellhead assembly in a conventional manner and a specially designed downhole unit. Finally, the assembly provides a method for allowing the well to produce hydrocarbons while tripping the drill string.

27 Claims, 6 Drawing Sheets

DYNAMIC MUDCAP DRILLING AND WELL CONTROL SYSTEM

BACKGROUND OF THE INVENTION

1. Field of the Invention

The present invention relates to a method and an apparatus for drilling a well. More particularly, the invention relates to a method and an apparatus for drilling a well in an underbalanced condition. More particularly still, the invention relates to a method and an apparatus enhancing safety of the personnel and equipment during drilling a well in an underbalanced condition using a dynamic column of heavy fluid.

2. Description of the Related Art

Historically, wells have been drilled with a column of fluid in the wellbore designed to overcome any formation pressure encountered as the wellbore is formed. In additional to control, the column of fluid is effective in carrying away cuttings as it is injected at the lower end of drill string and is then circulated to the surface of the well. While this approach is effective in well control, the drilling fluid can enter and be lost in the formation. Additionally, the weight of the fluid in the wellbore can damage the formation, preventing an adequate migration of hydrocarbons into the wellbore after the well is completed. Also, additives placed in the drilling fluid to improve viscosity can cake at the formation and impede production.

More recently, underbalanced drilling has been used to avoid the shortcomings of the forgoing method. Underbalanced drilling is a method wherein the pressure of drilling fluid in a borehole is intentionally maintained below the formation pressure in wellbore.

In underbalanced drilling operations, a rotating control head (RCH) is an essential piece of wellhead equipment in order to provide some barrier between wellbore pressure and the surface of the well. A RCH is located at the top of the well bore to act as barrier and prevent leakage of return fluid to the top of the wellhead so that personnel on the rig floor are not exposed to produced liquid and hazardous gases. An RCH operates with a rotating seal that fits around the drill string. The rotating seal is housed in a bearing assembly in the RCH. Because it operates as a barrier, the RCH is often subjected to high-pressure differential from below. In order for the RCH to work properly, stripper rubber elements designed to seal the drill pipe must fit around the drill pipe closely. These rubber elements are frequently changed on the job with new elements to ensure proper functioning of the RCH. However, even with frequent change of these elements, operators are often concerned about the safety on the high-pressure wells, especially where hazardous gases are expected with the return fluid. Additionally, in relatively high-pressure gas wells the use of drilling fluid density for controlling return flow pressure lowers production from the well and requires the produced gas be recompressed before it is fed into a service line or used for re-injection.

In another form of underbalanced drilling, two concentric casing strings are disposed down the wellbore. Drilling fluid is pumped into the drill string disposed inside the inner casing. A surface RCH is connected to the drill string at the wellbore. Another fluid is pumped into an annulus formed between the two casing strings. Thereafter, both of the injected fluids return to the surface through an annulus formed between the drill string and inner casing. Gas rather then fluid may be pumped into the outer annulus when drilling a low-pressure well to urge return fluid up the annulus. Conversely, when drilling a high pressure well, fluid is preferred because the hydrostatic head of the fluid can control a wide range of downhole pressure. The operator can regulate the downhole pressure by varying the flow rate of the second fluid. This method has a positive effect on the rotating control head (RCH) in high-pressure wells because the pressure of returning fluid at the wellhead is reduced to the extent that there is added friction loss. However, the RCH is not isolated from produced fluids therefore imposes a safety risk on rig operators from leakage of produced fluid due to a failure in the RCH.

A mudcap drilling system is yet another method of underbalanced drilling. This drilling method is effective where the drilling operator is faced with high annular pressure. FIG. 1 is a section view showing a traditional mud cap drilling system. After a borehole is drilled, a casing 30 is disposed therein and cemented in the wellbore 15. A drill string 35 is disposed in the wellbore 15 creating an annulus 10 between the casing 30 and the drill string 35. The drill operator loads the annulus 10 by pumping a predetermined amount of heavy density fluid in an inlet port 60. This fluid is designed to minimize gas migration up the annulus 10. After the fluid reaches the predetermined hydrostatic pressure, the drill operator shuts in an inlet port 60.

As illustrated on FIG. 1, the system includes a rotating control head (RCH) 50 at the surface of the wellhead 15. The RCH 50 includes a seal that rotates with the drill string 35. The heavy density fluid applies an upward pressure on the downward facing RCH 50, thereby sealing off the outer diameter of the drill string 35. The purpose of the RCH 50 is to form a barrier between the heavy density fluid mudcap and the rig floor. At this point, the shut in surface pressure on the annulus plus the hydrostatic pressure resulting from the heavy density fluid equals the formation pressure. This annular column of heavy density fluid is held in place by a pressure barrier 45 created between hydrostatic fluid column pressure and the downhole pressure. To offset any annular loses of fluid into to the formations 25, it may be necessary to add fluid to the mudcap in the same sequence as it was initially introduced. Additionally, the system also includes a blow out preventor 55 (BOP) disposed at the surface of the well for use in an emergency. Thereafter the mudcap is established, the drilling operation may continue pumping clean fluid that is compatible with the formation fluids down a drill string 30 exiting out nozzles in a drill bit 40. A permeable formation fracture 25 receives the drilling fluid as it pumped down the drill string 30. A term used in the oil and gas industry called "bullheading" results due to the formation of the barrier 45 at the bottom of the annular column 10 between the heavy density fluid and hydrocarbon formation pressure. The barrier 45 prevents drilling fluid returning to the surface, thereby urging the fluid into the formations 25. Although this process requires specialized well control and well circulation equipment during the mudcap drilling operation, there is no need for extensive fluid separation system since the formation fluids are kept downhole.

There are several problems that exist with the traditional mudcap drilling system. For example, as with other forms of well control the surface rotating control head (RCH) is the only barrier between the high-pressure return fluid and personnel on the rig floor. The operators are often concerned about safety on high-pressure wells since there is no early warning system in place. In another example, the RCH stripper rubbers wear out rapidly due to the high differential pressure. These stripper rubbers need to be changed periodically on the job to ensure proper functioning of the RCH. This is a costly operation in terms of rig time and cost of the rubber elements. In a further example, this drilling method can only operate if a permeable fracture or formation exists because all the drilling fluids are not returned to the surface but are being pumped into a permeable fracture. This drilling fluid loss is also a costly investment. In yet a further example, reservoir damage can occur due to the lack of control of a true underbalanced state between the fluid column pressure and the formation pressure, thereby reducing the productivity of the well. In the final example, the well does not produce hydrocarbons while tripping the drill string in a traditional mudcap drilling operation.

In view of the deficiencies of the traditional mudcap drilling system and other well control methods, a need exists to ensure the safety of the rig operators by providing an early warning system to tell the operators that a potential catastrophic problem exists. There is a further need to extend the life of the RCH due to the high cost of non-productive rig time as a result of replacing the rubber part. There is yet a further need to save operational costs and prevent formation damage by allowing the drilling fluid to return to the surface of the wellhead while maintaining the benefits of a traditional mudcap system. There is yet even a further need for a mudcap assembly, which allows the well to produce hydrocarbons while tripping the drill string.

SUMMARY OF THE INVENTION

The present invention provides a method and an apparatus for a dynamic mudcap drilling and well control assembly. In one embodiment, the apparatus comprises of a tubular body disposable in a well casing forming an outer annulus there between and an inner annulus formable between the body and a drill string disposed therein. The apparatus further includes a sealing member to seal the inner annulus at a location above a lower end of the tubular body and a pressure control member disposable in the inner annulus at a location above the lower end of the tubular body.

In another embodiment, the assembly uses two rotating control heads, one at the top of the wellhead assembly in a conventional manner and a specially designed downhole unit. Thus, creating dual barriers preventing any potential leak of produced gases or liquid hydrocarbon on to the rig floor, thereby ensuring the safety of the rig operators. Furthermore, the assembly provides an early warning method for detecting catastrophic failure in any of the two rotating control heads. Additionally, the assembly provides a practical method for reducing wear on the RCH stripper rubbers by ensuring the pressure differential across both the surface and downhole RCH is small, thereby extending the life of the RCH and reducing the non-productive time of the rig due to periodic replacement of the rubber part in the RCH. Further, the assembly provides for a way of circulating the return flow to the top of the wellbore thereby reducing cost of drilling by utilizing the return drilling fluid. Further yet, the assembly provides a practical method for containing and controlling wellhead pressure of return fluids by use of a high-density fluid column. Additionally, the assembly using a WEATHERFORD® deployment valve allows the well to continue to produce hydrocarbons without any drill string in the well bore. Finally, the assembly provides a method for allowing the well to produce hydrocarbons while tripping the drill string.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
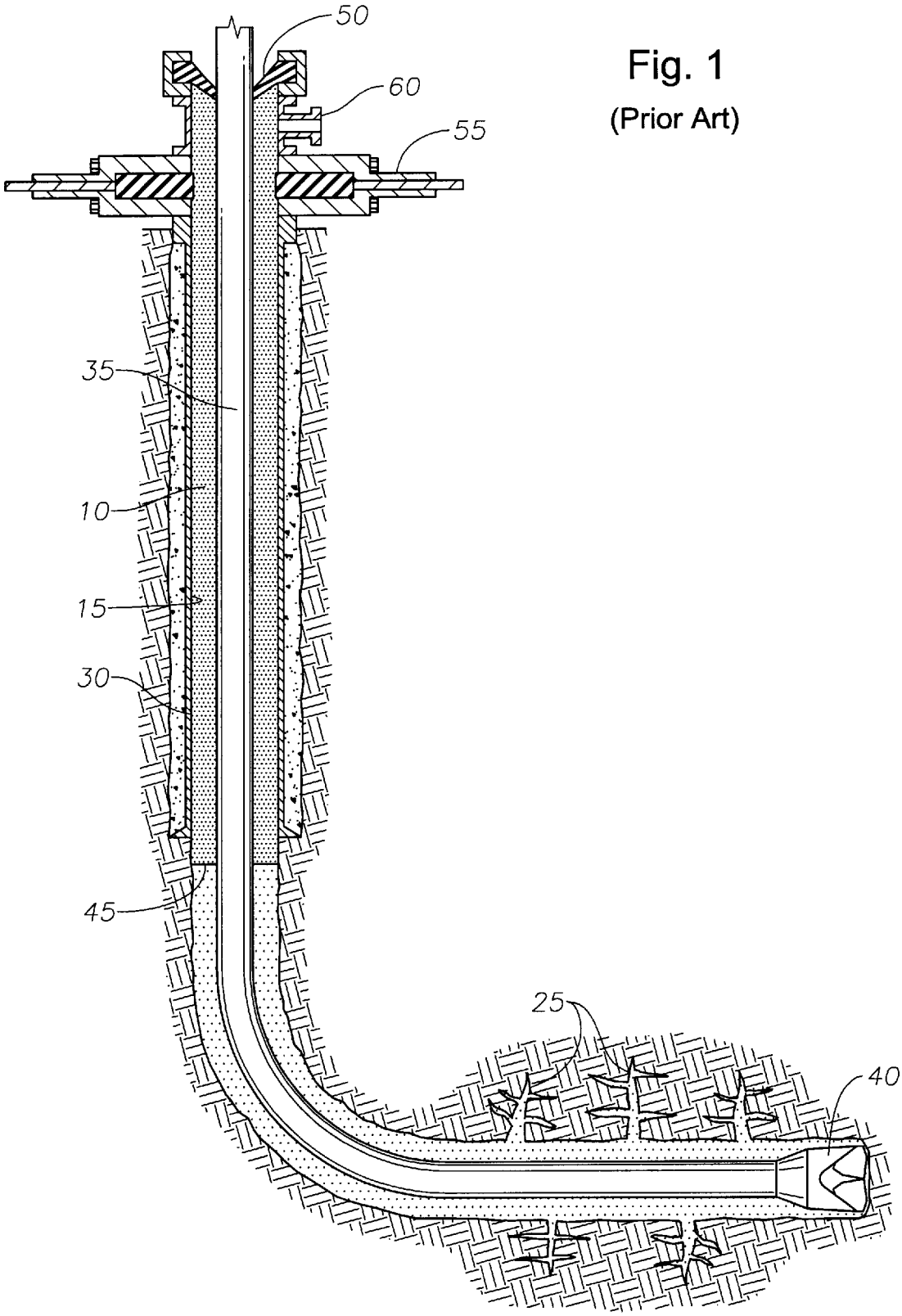
Fig. 1 (Prior Art)
FIG. 1 is a section view showing a traditional mud cap drilling operation.
Figure 2:
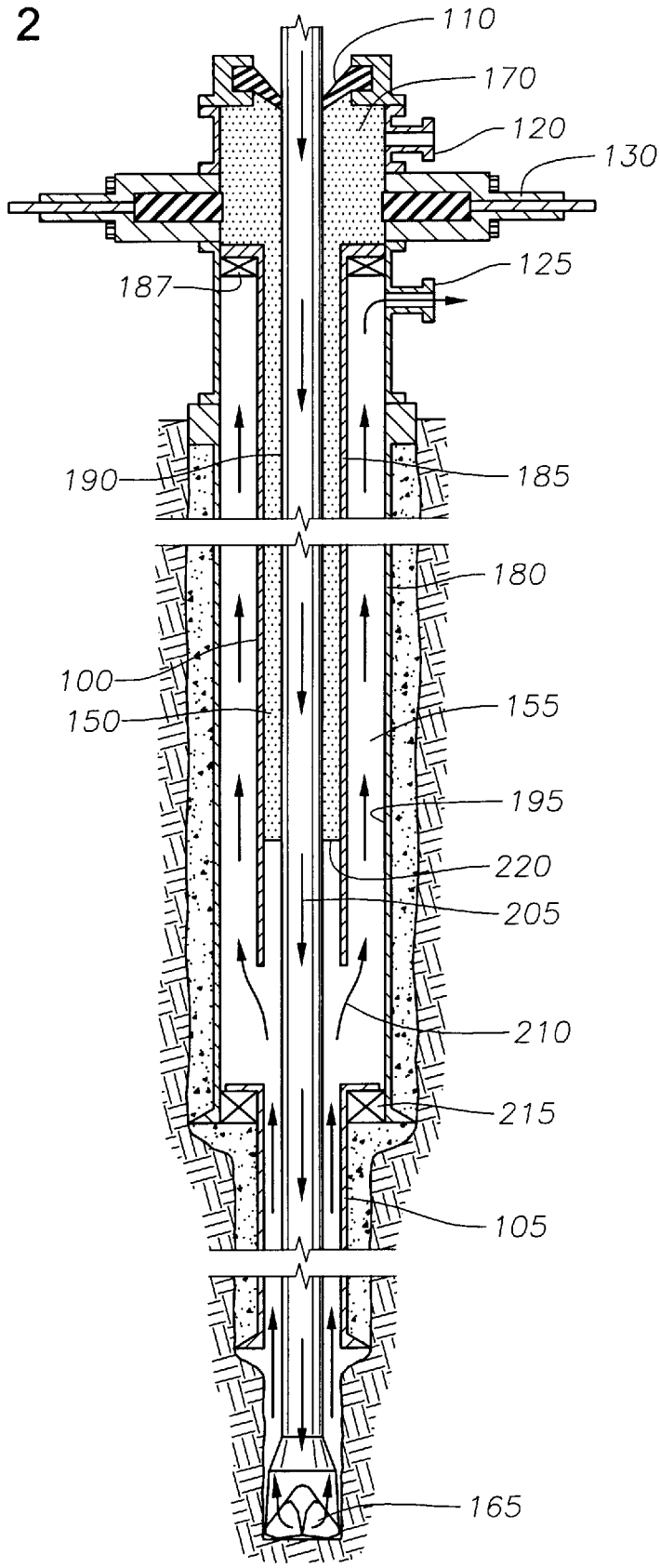
FIG. 2 is a section view of one embodiment of a dynamic mudcap drilling and well control assembly of the present invention.

FIG. 2 is a section view of one embodiment of a dynamic mudcap drilling and well control assembly 100 of the present invention. The assembly 100 comprises of two concentric casings, an outer casing 180 and an inner casing 185. In the embodiment shown in FIG. 2, the outer casing 180 is the wellbore casing and is cemented in a wellbore 195. The inner casing 185 is disposed coaxially in the outer casing 180, thus creating an outer annulus 155 between the outer casing 180 and the inner casing 185. An inner annulus 150 is formed between the inner casing 185 and a drill string 190, which extends through a bore of the inner casing 185. The inner casing 185 is tied to the wellhead by an inner casing hanger 187 located at the surface of the well. Additionally, a liner 105 is attached at the lower end of the outer casing 180 by a liner hanger 215.

A sealing member is disposed at the upper end of the assembly 100. In the embodiment, the sealing member is a rubber stripper or a surface rotating control head (RCH) 110. However, other forms of sealing members may be employed, so long as they are capable of maintaining a sealing relationship with the drill string 190. Typically, the surface RCH 110 includes a seal that rotates with the drill string 190. The seal contact is enhanced as a pressure control member, such as a high density fluid column 170, applies upward pressure on the downward facing surface RCH 110, thereby pushing the surface RCH 110 against the drill string 190 and sealing off the outer diameter of the drill string 190. The purpose of the RCH 110 is to form a barrier between the inner annulus 150 and the rig floor. Below the surface RCH 110 is a valve member 120 to permit fluid communication between the surface of the well and the inner annulus 150. As shown, an upper blow out preventor (BOP) 130 is disposed on the surface of the well for use in an emergency. Additionally, a return port 125 permits fluid to exit the well surface.

In the embodiment shown on FIG. 2, drilling fluid, as illustrated by arrow 205, is pumped down the drill string 190 exiting out a drill bit 165. The drilling fluid combines with the downhole fluid to create a downhole pressure. The down hole pressure acts against the hydrostatic pressure due to the heavy density fluid 170, thereby creating a pressure barrier 220. One function of the pressure barrier 220 is to maintain the heavy density fluid 170 within the inner annulus 150. Another function of the pressure barrier 220 is to prevent hydrocarbons from traveling up the inner annulus 150. As illustrated by arrow 210, the hydrocarbons are urged by the wellbore pressure up the liner 105 into the outer annulus 155 then exiting out port 125. In this manner, the assembly of the present invention offers advantages of a prior art mudcap and the ability to produce the well at the same time.

Figure 3:
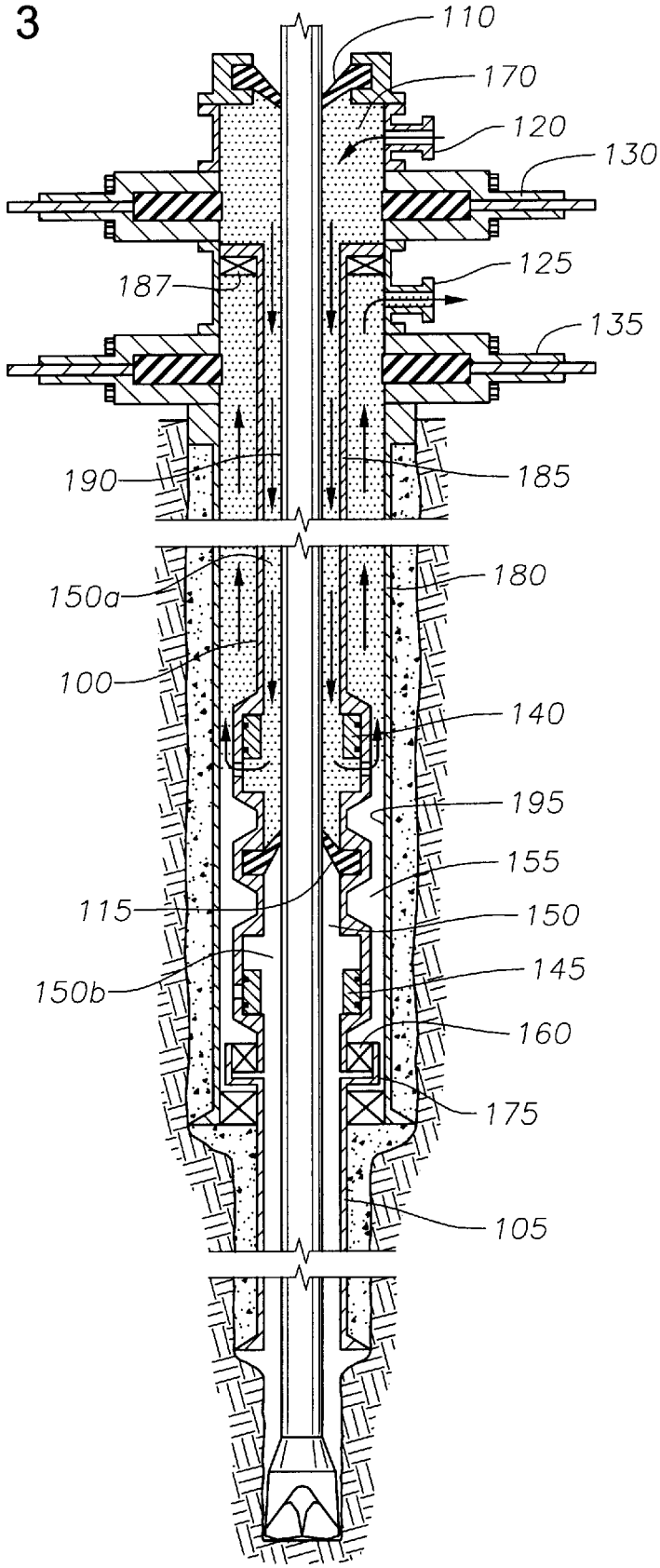
FIG. 3 is a section view of another embodiment of a dynamic mudcap drilling and well control assembly illustrating the placement of high density fluid in an inner annulus.

FIG. 3 is a section view of another embodiment of a dynamic mudcap drilling and well control assembly 100 illustrating the placement of high density fluid 170 in the inner annulus 150. The inner annulus 150 is divided by a rotating control head (RCH) 115 into an upper annulus 150*a* and a lower annulus 150*b* as shown on this embodiment. The assembly 100 also includes an outward extending seal assembly 160 at a lower end of the inner casing 185. The seal assembly 160 mates with a polish bore receptacle (PBR) 175 formed at an upper end of the liner 105; the liner 105 is centered in the wellbore. The seal assembly 160 and the PBR 175 permit a fluid tight relationship between the assembly 100 and the liner 105. As further illustrated, the upper blow out preventor (BOP) 130 and a lower blow out preventor (BOP) 135 are disposed on the surface of the well for use in an emergency.

In this embodiment, the pressure control member comprises of the fluid column 170 and the rotating control head (RCH) 115. The RCH 115 includes a seal that rotates the drill string. The high-density fluid column 170 applies downward pressure on the upward facing RCH 115 thereby pushing the RCH 115 against the drill string 190 and sealing off the outer diameter of the drill string 190.

As illustrated on FIG. 3, a circulating valve 140 is disposed on the inner casing 185 above the RCH 115. The circulating valve 140 provides fluid communication between upper annulus 150*a* and outer annulus 155. As further illustrated, the assembly 100 also includes an annulus return valve 145 disposed at the lower end of in the inner casing 185. The annulus return valve 145 facilitates fluid communication between the lower annulus 150*b* and the outer annulus 155.

The assembly of FIG. 3 is constructed when the assembly 100 is inserted into the wellbore 195 forming the outer annulus 155 between the wellbore casing 180 and the inner casing 185. The circulating valve 140 and the annulus control valve 145 are in the open position allowing displaced hydrocarbons to exit. Next, the assembly 100 is secured in the wellbore 195 by the inner-casing hanger 187. Additionally, a fluid tight relationship is formed by mating the seal assembly 160 on the lower end of the assembly 100 to the PBR 175 at the upper end of the liner 105. Thereafter, A drill string 190 is inserted in the bore of the inner casing 185, thereby forming the upper annulus 150*a* and lower annulus 150*b*. As shown, the surface RCH 110 and the RCH 115 seal off the upper annulus 150*a* for a high-density fluid column 170.

In operation, the following steps occur to fill the upper annulus 150*a* with high-density fluid. First, annulus return valve 145 is closed, thereby preventing hydrocarbons in the inner annulus 150 to enter the outer annulus 155. Second, the circulating valve 140 is opened to allow fluid communication between upper annulus 150*a* and outer annulus 155. Third, a predetermined amount of high density fluid is pumped into the valve member 120 by an exterior pumping device, thereby displacing excess fluid in the upper annulus 150*a* out the circulating valve 140 into the outer annulus 155 exiting out the return port 125. Fourth, after the upper annulus 150*a* is filled with high-density fluid, the circulating valve 140 is closed to retain the high-density fluid in the upper annulus 150*a*. Fifth, the valve member 120 is closed to prevent leakage from the top of the fluid column. In the final step, the annulus return valve 145 is selectively opened to communicate hydrocarbons from the inner annulus 150 to the outer annulus 155 for collection at the return port 125.

One use of the high-density fluid column 170 is to control pressure differential across the RCH 115. The weight of the fluid column 170 is adjustable; it can be changed in response to the dynamic wellbore conditions. During operation of the assembly, the hydrostatic head of high-density fluid acting from above on the stripper rubber in the RCH 115 counters return fluid pressure from below leaving a small differential pressure across the stripper rubber thus enhancing the service life of the stripper rubbers. However, if the return fluid pressure is greater than the hydrostatic head of high-density fluid, the high-density fluid is pressurized at the surface to maintain pressure difference across the stripper rubber within the acceptable range. Conversely, if in return fluid pressure is much lower than the hydrostatic head above the downhole RCH 115 then some of the high-density fluid column is removed by opening the valve member 120 and the circulating valve 140, thereby allowing high density fluid in the upper annulus 150*a* to pass through the circulating valve 140 and up the outer annulus 155 exiting through the return port 125. In this manner the assembly 100 of the present invention offers advantages of a prior art mudcap and the ability to reduce wear in the RCH.

Figure 4:
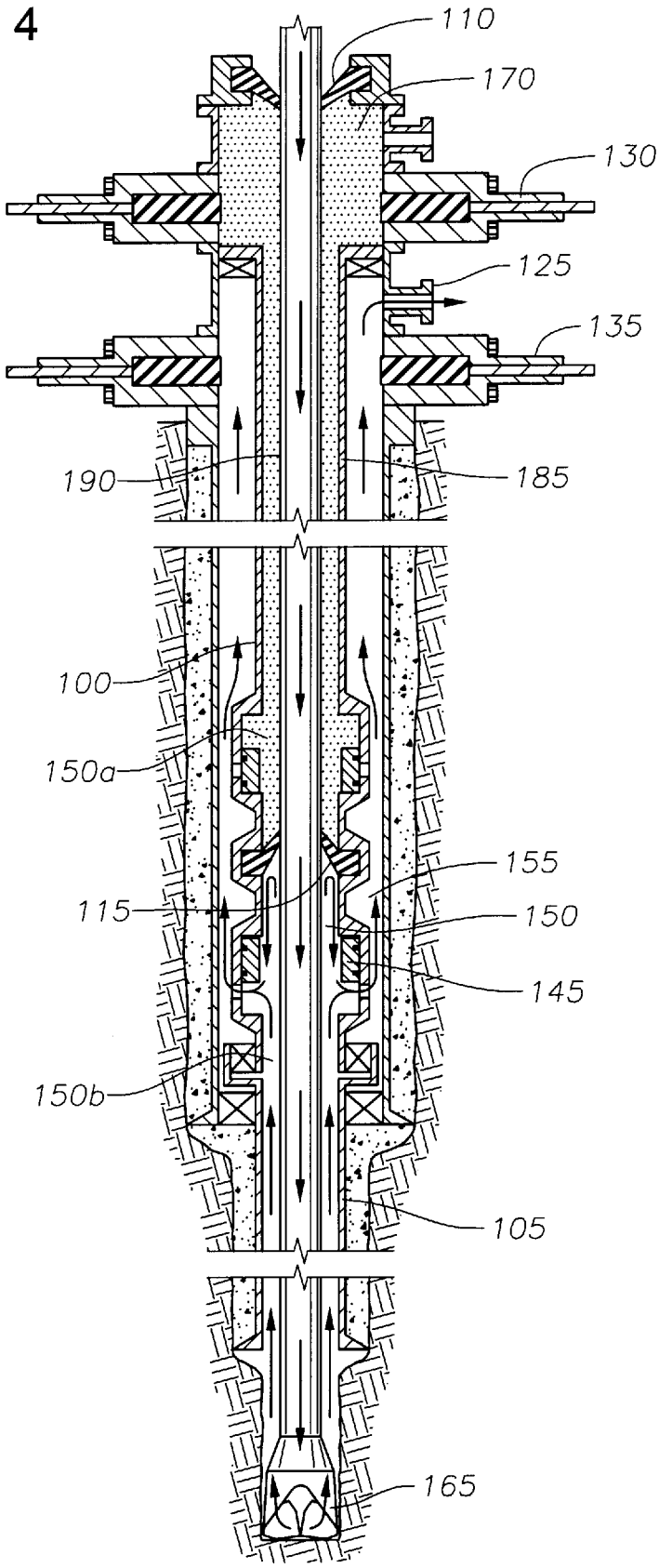
FIG. 4 illustrates the annulus return valve in the open position during a drilling operation using a mudcap drilling and well control assembly.

FIG. 4 illustrates the annulus return valve 145 in the open position during a drilling operation using the mudcap drilling and well control assembly 100. The main function of the annulus control valve 145 is to selectively communicate return fluid from the lower annulus 150*b* to the outer annulus 155. During a drilling operation the annulus control valve 145 is in the open position. Drilling fluid is pumped into the drill string 190 and exits through nozzles in the drill bit 165. The return fluid consisting of drilling fluid and hydrocarbons produced into the wellbore is urged up the liner 105 into the lower annulus 150*b* formed between the drill string 190 and the inner casing 185 by formation pressure. The RCH 115 stops the upward flow of return fluid in the lower annulus 150*b* forcing it toward the annulus return valve 145. The return fluid is selectively communicated between the lower annulus 150*b* and the outer annulus 155 through the ports in the annulus return valve 145. Upon entering the outer annulus 155 the fluid is urged upward exiting out a return port 125 at the surface of the wellhead.

The preferred embodiment has several safety features. For example, during a drilling operation the annulus return valve 145 can be closed using a surface control device, thereby causing the well to be shut in downhole. Therefore, no return fluid is communicated to the outer annulus 155 from the inner annulus 150 and the seal formed between the RCH 115 and the drill string 190 prevents return fluid from continuing up the inner annulus 150. Another example, the surface RCH 110 situated below the rig floor is completely isolated from the return fluid. Fluid pressure below the surface RCH 110 increases only if the downhole RCH 115 develops a leak causing high-density fluid in the inner annulus 150 to become pressurized. If a leak also occurs in the surface RCH 110 at the same time, high-density fluid would leak out the surface RCH 110 before any return fluid reaches the rig floor thereby providing sufficient time for remedial action such as closing the BOP 130, 135. In practice, the pressure of the high-density fluid column 170 could be continuously monitored. Any change of pressure in high-density fluid column 170 would give a good indication of the condition of stripper rubber in the RCH 115.

Figure 5:
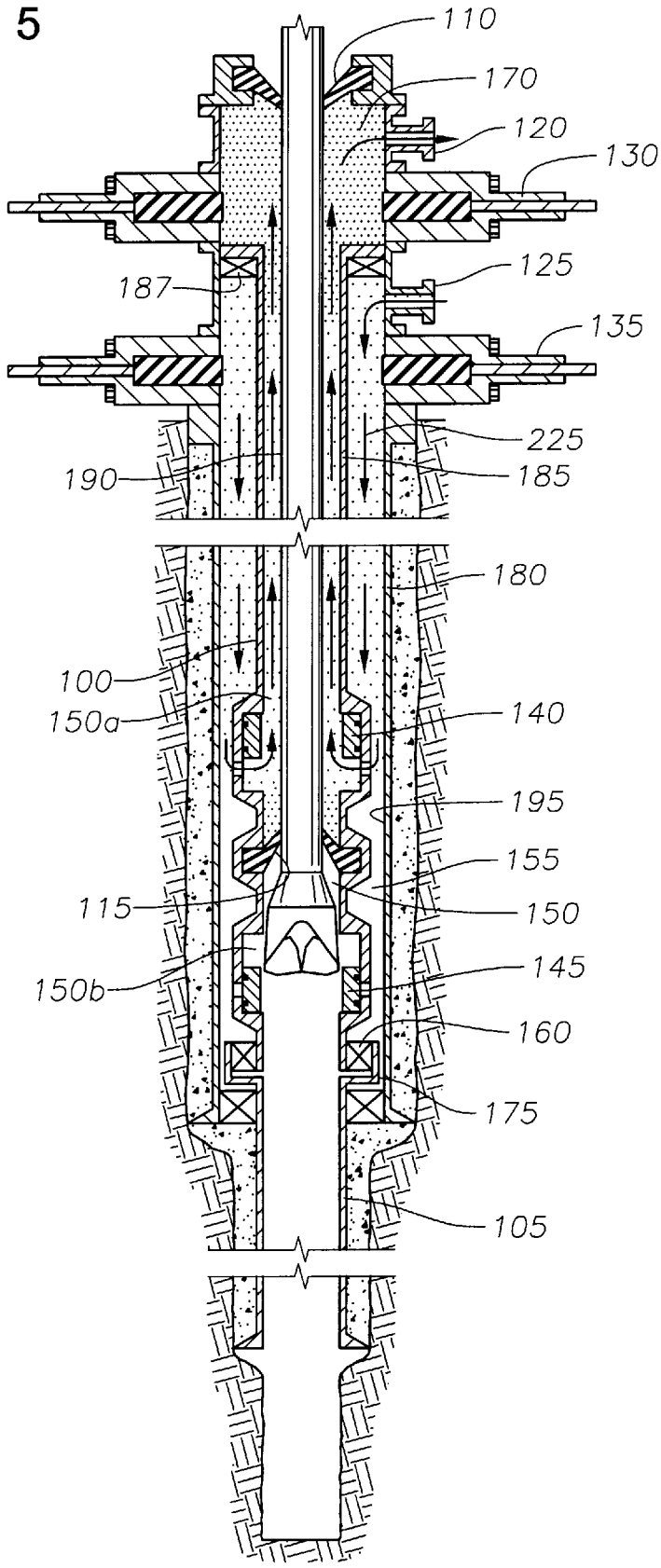
FIG. 5 is a section view of a dynamic mudcap drilling and well control assembly illustrating the removal of high density fluid from the inner annulus.

FIG. 5 is a section view of a dynamic mudcap drilling and well control assembly 100 illustrating the removal of high density fluid 170 from the inner annulus 150. As shown, the drill string 190 is raised to a point below the RCH 115. Thereafter, a lighter fluid, as illustrated by arrow 225, is pumped into the port 125 at the surface of the well. The lighter fluid flows down the outer annulus 155 and then through the open circulation valve 140 into the upper annulus 150*a*. Subsequently, the lighter fluid displaces the high density fluid column 170 causing the high density fluid 170 to exit through the open valve member 120. This process continues until the high density fluid 170 is removed from the upper annulus 150*a*. Thereafter, the drill string 190 is removed.

Figure 6:
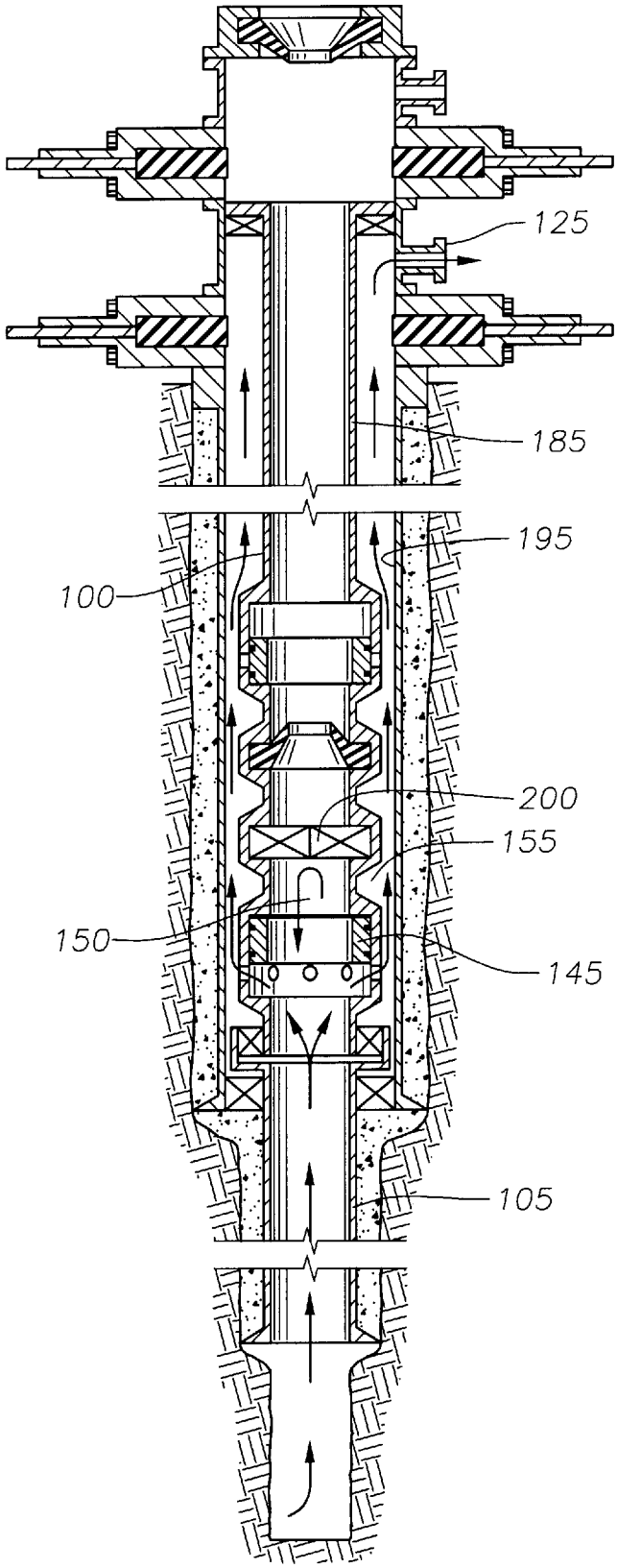
FIG. 6 is a section view of a dynamic mudcap drilling and well control assembly with a WEATHERFORD® deployment valve disposed in the inner casing string.

FIG. 6 is a section view of a dynamic mudcap drilling and well control assembly 100 with a WEATHERFORD® deployment valve 200 disposed in the inner casing 185. In this embodiment, the WEATHERFORD® deployment valve 200, U.S. Pat. No. 6,209,663, is disposed in the inner casing 185 at a predetermined point above the annulus return valve 145. The predetermined point is based upon the weight of the drill string 190 (not shown) and the down hole pressure. During a drilling operation the deployment valve 200 is in the open position, thereby allowing the drill string 190 to pass through the valve 200 without interference.

The deployment valve 200 increases the functionality of the mudcap drilling and well control assembly 100. For example, during a drilling operation if a drill bit or a motor needs replacement, the drill string 190 is pulled from the wellbore to a point above the deployment valve 200. Thereafter, the valve 200 is closed preventing return fluid continuing up the inner annulus 150. Therefore, the drill string 190 is pulled from the wellbore 195 without any effect of down hole fluid pressure. Upon re-insertion, the drill string 190 is lowered in the wellbore 195 to a point above the deployment valve 200, thereafter the valve 200 is opened permitting further insertion in the wellbore 195.

Another example is the ability to produce hydrocarbons without the drill string disposed in the wellbore 195, as illustrated on FIG. 6. The valve 200 is closed after the drill string is removed from the wellbore. Wellbore fluid is urged up the liner 105 by downhole pressure. The wellbore fluid enters the open annulus return valve 145, then selectively communicated from the lower annulus 150*b* to the outer annulus 155. Thereafter, the wellbore fluid travels up the outer annulus 155 exiting out the return port 125 for collection. A final example is the ability to close the deployment valve 200 and the annulus return valve 145 to effectively shut in the well for safety reasons.

While the foregoing is directed to embodiments of the present invention, other and further embodiments of the invention may be devised without departing from the basic scope thereof, and the scope thereof is determined by the claims that follow.

What is claimed is:

1. An apparatus for controlling a well comprising:

a tubular body disposable in a well casing, the tubular body having a lower end;

an outer annulus formed between the well casing and the tubular body and an inner annulus formable between the tubing body and a drill string disposed therein;

a sealing member to seal the inner annulus at a location above the lower end of the tubular body; and a pressure control fluid retainable in the inner annulus at a location above the lower end of the tubular body.

2. The apparatus of claim 1, wherein the pressure control fluid includes drilling mud.

3. The apparatus of claim 2, further including a rubber stripper or a rotating control head.

4. The apparatus of claim 1, further including an opening in the tubular body to permit fluid communication between an interior of the tubular body and the outer annulus.

5. The apparatus of claim 4, whereby the opening includes a valve member for selectively permitting fluid communication between the interior of the tubular body and the outer annulus.

6. The apparatus of claim 1, wherein the sealing member consists of a rubber stripper or a rotating control head.

7. The apparatus of claim 1, further including a circulating valve disposed on the body to selectively permit flow between the inner annulus and outer annulus.

8. The apparatus of claim 1, further including an inlet for pumping in high density fluid into the inner annulus and shutting off the well.

9. The apparatus of claim 8, further including a return port for allowing return fluid to exit the top of the well.

10. The apparatus of claim 1, further including a lower BOP to shut off the inner annulus thereby preventing returning fluid and gas from flowing up the inner annulus.

11. The apparatus of claim 10, further including an upper BOP for shutting off the outer annulus thereby preventing return fluid and gas from flowing up the outer annulus.

12. The apparatus of claim 1, further including an inner casing hanger for securing the apparatus in the well casing.

13. The apparatus of claim 1, further including a deployment valve for closing the downhole inner annulus thereby allowing the well to produce without the drill string; eliminating pipe light while tripping in and out the drill string; adding additional safety by preventing the return fluid and gas from flowing up the inner annulus.

14. A method of controlling a well comprising:

disposing a tubular body in a well casing, whereby an outer annulus is formed therebetween and the tubular body having a lower end;

disposing a drill string within the tubular body, whereby an inner annulus is formed therebetween;

sealing a location above the lower end of the tubular body using a sealing member;

disposing a pressure control fluid in the inner annulus at a location above the lower end of the tubular body; and retaining the pressure control fluid in the inner annulus.

15. The method of claim 14, wherein the pressure control fluid includes drilling mud.

16. The method of claim 15, further including disposing a rubber stripper or a rotating control head proximate the lower end of the tubular body.

17. The method of claim 14, wherein the sealing member consists of a rubber stripper or a rotating control head.

18. The method of claim 14, wherein the tubular body includes an opening to permit fluid communication between an interior of the tubular body and the outer annulus.

19. The method of claim 18, whereby the opening includes a valve member for selectively permitting fluid communication between the interior of the tubular body and the outer annulus.

20. The method of claim 19, whereby the tubular member further includes a circulating valve disposed on the body to selectively permit flow between the inner annulus and outer annulus, an inlet for filling the inner annulus, a return port for allowing multiphase matter to pass out of the assembly and a deployment valve.

21. The method of claim 20, further including the step of filling the inner annulus which includes:

opening an inlet to the inner annulus at the surface of the well;

closing the valve member;

opening the circulating valve;

opening the return port;

pumping a pre-selected fluid into the inner annulus, thereby expelling any existing fluid in the inner annulus;

closing the circulating valve; and closing the inlet.

22. The method of claim 20, further including the step drilling the well which includes:

opening the valve member;

opening the return port thereby allowing return fluid to exit assembly;

operating the drill string;

pumping drilling fluid down the drill string; and allowing return fluid to flow up inner annulus then through the valve member and up the outer annulus exiting out the return port.

23. The method of claim 20, further including the step of ensuring the safety of an operators which includes:

closing the valve member thereby preventing flow between the inner and outer annulus;

closing the deployment valve thereby restricting the return flow up the inner annulus; and opening the return port thereby allowing excess return fluid to exit the outer annulus.

24. An apparatus for controlling a well comprising:

a tubular body disposable in a well casing, the tubular body having a lower end;

an outer annulus formed the well casing and the tubular body and an inner annulus formable between the tubing body and a drill string disposed therein;

a sealing member to seal the inner annulus at a location above the lower end of the tubular body;

a pressure control member disposable in the inner annulus at a location above the lower end of the tubular body;

an opening in the tubular body to permit fluid communication between an interior of the tubular body and the outer annulus, whereby the opening includes a valve member for selectively permitting fluid communication between the interior of the tubular body and the outer annulus.

25. A method of controlling a well comprising:

disposing a tubular body in a well casing to form an outer annulus therebetween, wherein the tubular body includes a lower end and an opening having a valve member for selectively permitting fluid communication between an interior of the tubular body and the outer annulus;

disposing a drill string within the tubular body, whereby an inner annulus is formed therebetween;

sealing a location above the lower end of the tubular body using a sealing member; and disposing a pressure control member in the inner annulus at a location above the lower end of the tubular body.

26. An apparatus for controlling a well comprising:

an outer annulus formed between a casing and a tubular body;

an inner annulus formable between the tubular body and a drill string; and a fluid retainable in the inner annulus, whereby the fluid has a higher density then a wellbore fluid.

27. An apparatus for controlling a well comprising:

an outer annulus formed between a casing and a tubular body;

an inner annulus formable between the tubular body and a drill string; and a non-circulating fluid disposable in the inner annulus.

* * * * *